219-121 SR
3/26/85 OR 4,507,538

United States Patent [19]

Brown et al.

[11] Patent Number: 4,507,538

[45] Date of Patent: Mar. 26, 1985

[54] LASER HARDENING WITH SELECTIVE SHIELDING

[75] Inventors: Clyde O. Brown, Newington; Raymond E. Tourtellotte, East Hartford, both of Conn.

[73] Assignee: Mostek Corporation, Carrollton, Tex.

[21] Appl. No.: 436,142

[22] Filed: Oct. 22, 1982

[51] Int. Cl.[3] ..... B23K 27/00

[52] U.S. Cl. ..... 219/121 L

[58] Field of Search ..... 219/121, 121 PY, 121 EB, 219/121 EM, 121 L, 121 LM, 121 PA, 121 PC, 121 EF, 121 EG, 121 LE, 121 LF; 148/13, 141, 152

[56] References Cited

U.S. PATENT DOCUMENTS

| | | | |
|---|---|---|---|
| 4,017,708 | 4/1977 | Eagel et al. | 219/121 LE |
| 4,151,014 | 4/1979 | Charschan et al. | 219/121 LF X |
| 4,250,374 | 2/1981 | Tani | 219/121 LF X |
| 4,304,978 | 12/1981 | Saunders | 219/121 L X |

*Primary Examiner*—C. L. Albritton
*Attorney, Agent, or Firm*—Eric W. Petraske

[57] ABSTRACT

A method of surface hardening a metal corner includes the application of a laser beam to the surface, a portion of the beam being blocked by a cooled tube, so that the corner is heated by conduction from the heated areas.

3 Claims, 10 Drawing Figures

FIG. 2
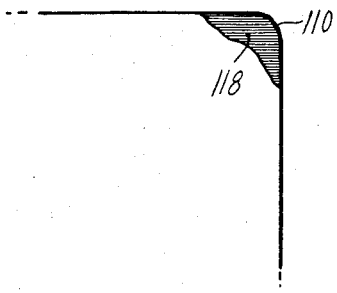
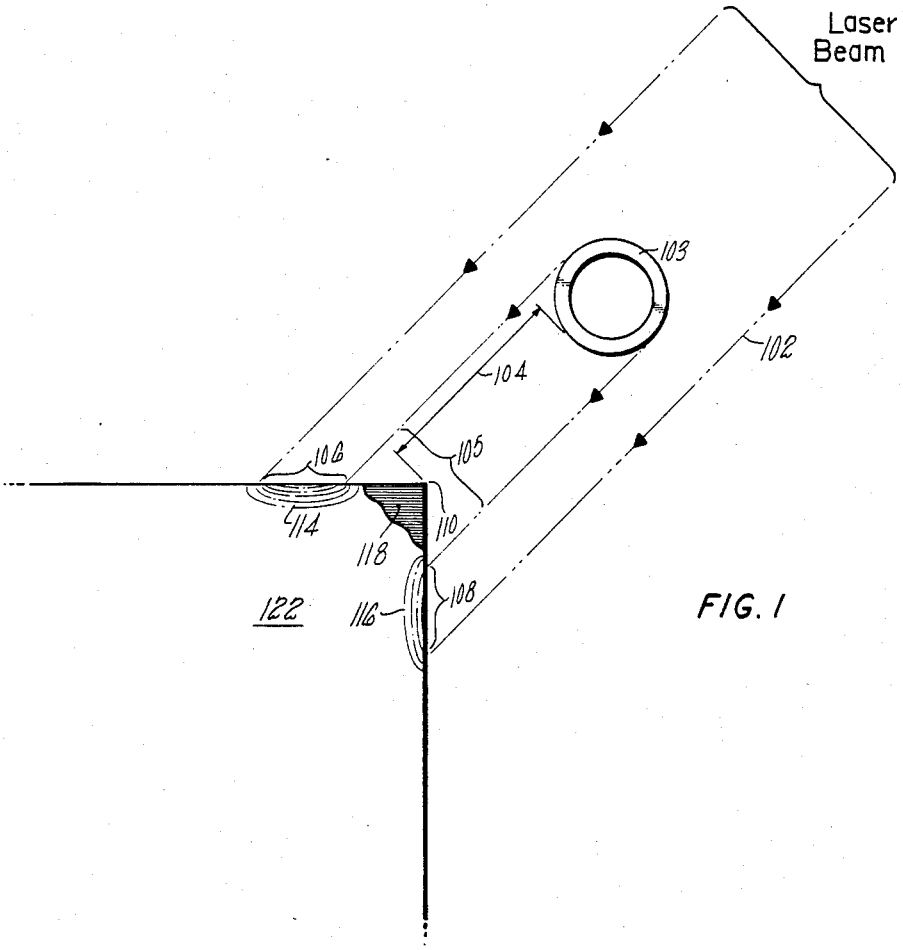
FIG. 1

FIG. 5
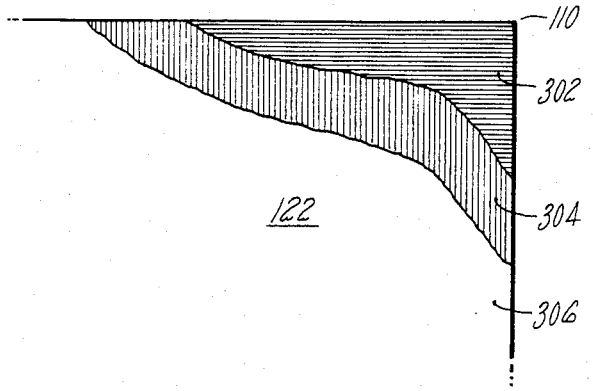
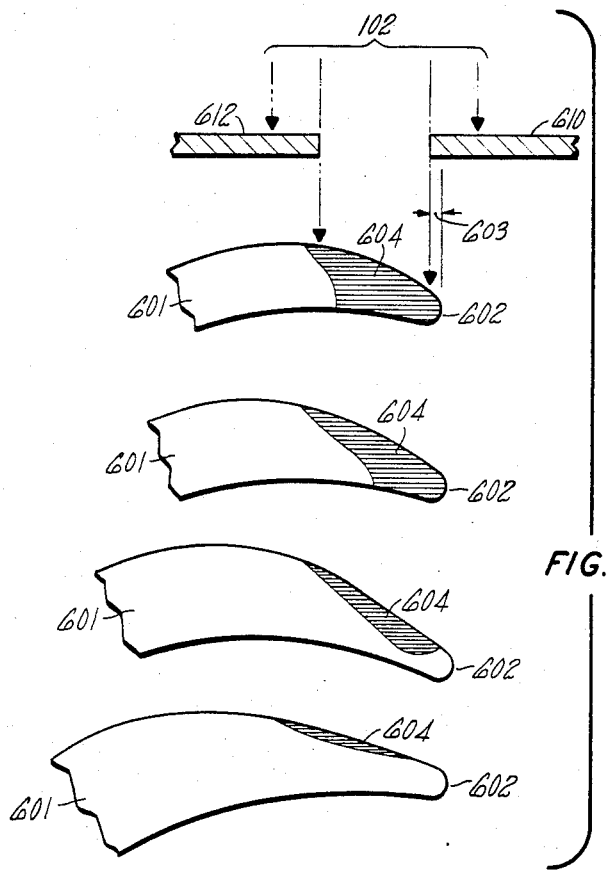
FIG. 6

LASER HARDENING WITH SELECTIVE SHIELDING

DESCRIPTION

1. Technical Field

The field of invention is hardening by heat treating a corner of a metal object that is exposed to wear.

2. Background Art

It is known that uniform heat applied to the corner and close-in edges of a metal object in order to provide hardening, melts the corner of the object. U.S. Pat. No. 2,196,902 discloses a method of hardening a corner in which two separate flames are applied perpendicular to the surface and are spaced from the corner by a specified amount. The hot gases from the flames necessarily flow along the surface as they strike it, thus spreading out the heat application for a certain distance beyond the dimension of the flame.

An article by Ole Sandven, entitled, "Laser Surface Transformation Hardening", in *Metals Handbook,* published by the America Society of Metals, in 1981, pp. 507–509, shows that the corner problem is still unsolved.

DISCLOSURE OF INVENTION

The invention relates to a method and apparatus for heat treating and thus hardening a corner of a metal object with an optical beam from a laser, in which the problem of corner melting is solved by placing a blocking device in a predetermined relationship to the corner; and by controlling the beam power and the speed with which the beam is swept over the surface.

A feature of the invention is exposing both sides of the cutting edge of a metal piece to a laser beam in which the corner is shielded by a tube of predetermined diameter.

Another feature of the invention is the exposure of a single side of a corner of a turbine blade to laser radiation, in which heat is conducted through the metal to the corner, the corner itself not being directly exposed to the laser radiation.

An advantageous feature of the invention is that the method is insensitive to misalignment of the laser beam.

BRIEF DESCRIPTION OF DRAWINGS

FIG. 1 illustrates in scale an embodiment of the invention.

FIG. 2 illustrates the melting of a cutting edge when exposed to unshielded laser radiation.

FIG. 5 illustrates the results of a hardness test using the subject invention.

FIG. 6 illustrates different results of tests on hardening a turbine blade.

BEST MODE FOR CARRYING OUT THE INVENTION

Figure 3A:
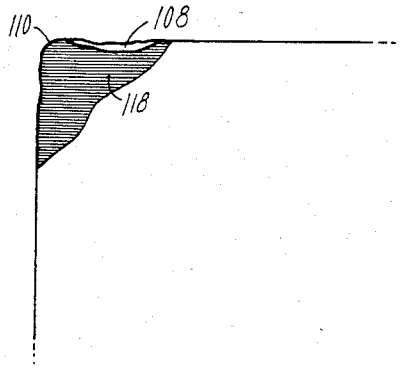
FIGS. 3A–3C illustrate the results of different tests made using a one-sixteenth inch diameter shield.

FIG. 1 illustrates a cross section of a 30-times magnification of an embodiment of the invention in which laser beam 102 is directed towards metal object 122, illustratively a metal cutting die formed from 4130 alloy steel having a sharp cutting edge 110. A portion of beam 102 is blocked by tube 103, illustratively a stainless steel thin-walled tube having a diameter of one-sixteenth inch and having a wall thickness of 0.01 inches through which water is flowed at a rate of 5 grams per second. Tube 103 is spaced apart from the corner of edge 110 by distance 104, illustratively one-sixteenth of an inch or less, to prevent thermal coupling of the tube and the workpiece. The portion of the surface area which is blocked by tube 103 is indicated by the line 105 in the diagram which is the diameter of tube 103. The portions of the surface upon which beam 102 strikes are indicated as areas 106 and 108, respectively. When beam 102 strikes the surface, it begins to heat up, as heat is absorbed. Isotherms, or lines of equal temperature, are sketched freehand and indicated by lines 114 and 116 in the figure. It can be seen that the heat spreads out as it conducts through the body of die 122 and that the two areas of heat will converge and meet in the corner of region 118. If heat is conducted easily through the die, region 118, at the tip, will reach the highest temperature since heat arrives there from both directions. In order for the well known hardening phenomenon to take place, the temperature in region 118 must exceed a critical temperature that is characteristic of the material. The region to be hardened must then be quenched. With the subject invention, quenching is effected by conductive cooling into the bulk of die 122.

In operation, beam 102 is swept along edge 110 (in a direction perpendicular to the plane of the paper in the drawing) at a predetermined rate which is one of the variables which may be altered to produce a desired result. Other variables are: the intensity distribution of beam 102, the total amount of power in the beam, the diameter of the beam, and the distance from the heated area to edge 110. These various parameters will affect the result differently and trade-offs will, of course, have to be made among them.

If the intensity in beam 102 is too high, then the surface of die 122 will melt in regions 106 and 108. This is undesirable, because it is economical to machine the object to the final dimension while it is soft. Melting will spoil the surface and, in many cases, require that the surface be remachined after it has been hardened. The speed with which beam 102 is swept along edge 110 also affects the surface melting, since it is the energy per unit area (or the product of (optical beam) intensity times the time during which the surface is exposed to beam 102) which determines whether the surface melts or not. Depending on the material being treated, it may be necessary to make a trade-off using a slower speed and a less intense beam so that the same amount of heat is deposited within the surface but the temperature is less and the surface does not melt. The relationship between the diameter of tube 103 and the size of areas 106 and 108 also affects the heat treatment of the corner, since the greater the diameter of the tube, the further the distance the heat has to travel and the less the tip at area 110 will become. If the amount of heat deposited is insufficient, then the temperature at the tip will not rise to the point at which hardening takes place. Conversely, if too much heat is deposited, even though the surface does not melt, the tip will become overheated as heat arrives from both directions and the tip will melt.

Tests have been made with beams of several configurations and different diameter blocking tubes. A typical example is a beam containing a power level of three kilowatts in a one-half inch by one-half inch square surface of uniform intensity. An alternate beam was used in a "doughnut" mode in which there is very little intensity at the center and the maximum intensity is at radius of about half the beam radius.

Beam 102 in FIG. 1 is shown as being symmetrically placed with respect to corner 110, but that is not necessary. It is an advantageous feature of the invention that it is not sensitive to misalignment, and beam 102 may be skewed considerably with respect to corner 110 and still produce satisfactory hardening at the corner.

FIG. 2 shows a drawing obtained by tracing a thirty-power photomicrograph of a piece of 4130 steel subjected to the standard beam treatment. In this case, corner 110 was not shielded, and the melting of the formerly square tip is clearly evident. The beam in this case was swept over the length of the corner at a speed of 5 inches per minute.

Figure 3B:
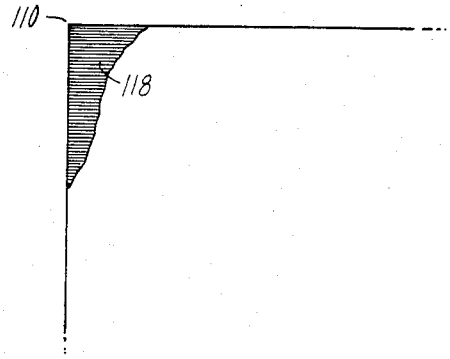
Figure 3C:
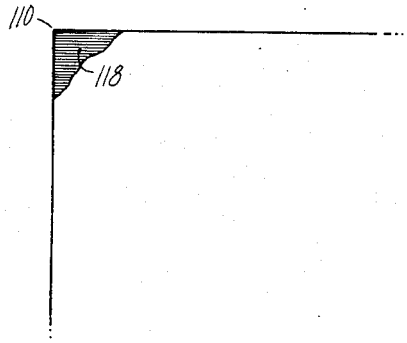

FIGS. 3A–3C illustrate different results at speeds of 2, 5 and 10 inches per minute, respectively. These drawings of photomicrographs were obtained using the one-sixteenth inch tube described with respect to FIG. 1 above. At 2 inches per minute, (FIG. 3A) corner 110 melted as can clearly be seen. Also, surface 108 melted which, as is described above, is an unsatisfactory result in cases where the die must be machined to the final shape before heat treating.

In FIGS. 3B and 3C, the result of the heat treatment was satisfactory; the corner is fully heat treated but is not melted.

Figure 4A:
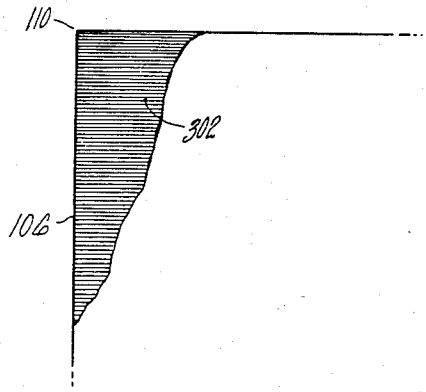
FIGS. 4A–4C illustrate the results of different tests made using a one-eighth inch diameter shield.
Figure 4B:
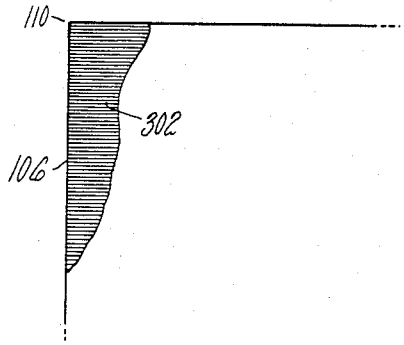
Figure 4C:
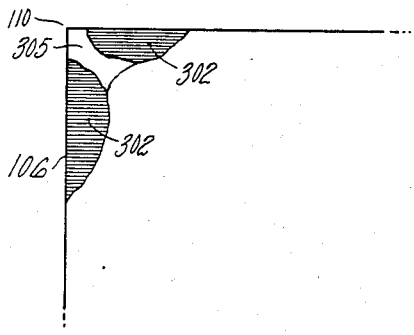

FIGS. 4A, B and C illustrate the same series of 2, 5 and 10 inches per minute on a sample which was shielded by a one-eighth inch diameter tube spaced one-sixteenth inch from corner 110. At 2 inches per minute (FIG. 4A), surface 106 melted slightly. At 5 inches per minute (FIG. 4B) there was a satisfactory result, with no melting at the corner or at the surface. At 10 inches per minute, the heat treatment area did not reach the corner and area 305 was not fully hardened. The treated areas in FIG. 4C are uneven because the beam was slightly skewed. These figures illustrate that the invention is also insensitive to the energy deposited—a further advantageous feature.

FIG. 5 illustrates a sample exposed with a one-half inch diameter beam having the "doughnut" intensity distribution characteristic of an unstable resonator and employing a one-eighth inch diameter shield. Hardness tests using the Vickers test were performed and results are indicated for three regions, 302, 304 and 306. The hardness region in 302 was between 48 and 50 on the Vickers scale. The hardness in region 304 was between 43 and 48 and the hardness in region 306 was between 38 and 43. This illustrates a very satisfactory distribution of hardness with the tip having a satisfactory hardness for a cutting edge grading over a distance of approximately 0.04 inches to the unhardened, ductile region of the body of 122.

FIGS. 6A–6B illustrate four different treatments of a turbine blade 601 in which the root of the blade, indicated as 602 in the figure, is to be hardened by laser treatment. The same laser beam 102 is blocked by two members 610 and 612 which may be adjusted to have a desired opening and may be offset from the edge of root 602 by a certain distance 603, which was about 0.01 inch. The position on root 602 at which a tangent to the surface of blade 601 is parallel to laser beam 102 will be referred to as the tangent point of the surface. Distance 603 is the distance, perpendicular to the axis of beam 102, between a tangent at the tangent point and the near edge of beam 102. The portion of blade 601 affected by the laser beam is indicated as 604. A series of tests were made with sweep speeds of 40, 45, 50 and 55 inches per minute. For reasons related to the intended application of the turbine blade, it was desired to have the hardening extend on the side away from the laser beam a distance of no more than 0.04 inches. The purpose of this restriction is to minimize the area of hardened zone on the wear edge of the blade. A large hardened area such as that produced by a sweep speed of 40 inches per minute becomes brittle and may fracture under the forces applied to it. As can be seen, a sweep speed intermediate between 45 inches per minute and 50 inches per minute will achieve the desired result. If the thickness of the turbine blade varies, it may be necessary to employ a sweep speed that varies correspondingly. If the particular edge limitation is not required for any given application, then those skilled in the art may readily calculate the desired sweep speed to produce a desired hardened area based on the foregoing information.

Beam 102 in this embodiment was produced by a carbon dioxide laser operating at 10.6 microns, but any optical beam that has enough intensity may be used. Similarly, the power distribution in the beam is not critical, though a uniform intensity distribution is preferred. The particular alloy steel used in the edge tests was 4130, but other alloys of steel or other methods may be used. Those skilled in the art will readily be able to make the required trade-offs in beam power and sweep speed in order to achieve satisfactory results with other alloys.

We claim:

1. A method of hardening an edge of a metal object comprising the steps of:

generating at least one source of heat, applying said at least one source of heat to at least two surface areas disposed on opposite sides of said edge and offset from said edge by a predetermined amount thereby defining a corner including said edge and bounded by said at least two surface areas, moving said at least one source of heat at a predetermined rate along a predetermined path substantially parallel to said edge, thereby extending said at least two suface areas in a direction parallel to said edge, whereby the temperature of said metal object in said corner is raised to a critical temperature characteristic of the metal of said metal object; and cooling said at least two surface areas, characterized in that:

said at least one source of heat is a single optical beam, having a beam area, from a laser, said step of applying heat to at least two surface areas is effected by blocking a portion of said beam area in front of said edge, thereby producing first and second beam areas striking said at least two surface areas on opposite sides of said edge, and said step of cooling said at least two surface areas is effected by conductive cooling into the bulk of said metal object.

2. A method according to claim 1, further characterized in that said beam has a beam intensity distribution in said first and second beam areas having a maximum value such that said at least two surface areas are heated to temperature that are less than the melting point of said metal as said beam is moved along said path.

3. A method of hardening with a laser beam a portion of a metal object having a front surface, a back surface and a curved surface joining said front and back surfaces, which curved surface has a tangent point at which a tangent to said curved surface is parallel to said laser beam comprising the steps of:

generating a laser beam having a predetermined power level;

directing said laser beam on an impact surface area within said front surface close to said curved surface;

moving said impact surface area along a path in said front surface, thereby extending said impact surface area along said path, whereby heat is conducted through said metal object from said impact surface area to said back surface and said curved surface and the temperature of said object at said curved surface is raised above a critical temperature characteristic of the metal of said metal object; and in which method, said laser beam is directed on said front surface along a path such that said tangent point of said curved surface is offset from said laser beam by a predetermined amount.

* * * * *

UNITED STATES PATENT AND TRADEMARK OFFICE

CERTIFICATE OF CORRECTION

PATENT NO. : 4,507,538

DATED : March 26, 1985

INVENTOR(S) : Clyde O. Brown, Raymond E. Tourtellotte

It is certified that error appears in the above-identified patent and that said Letters Patent is hereby corrected as shown below:

On the title page;

Item 73 Assignee should be changed from "Mostek Corporation, Carrollton, Tex." to --United Technologies Corporation, Hartford, Conn.--

Signed and Sealed this

*Twenty-third* Day of *July 1985*

[SEAL]

*Attest:*

DONALD J. QUIGG

*Attesting Officer* *Acting Commissioner of Patents and Trademarks*